United States Patent [19]

Kulesza et al.

[11] 4,413,443

[45] Nov. 8, 1983

[54] TOY VEHICLE DEVICE

[75] Inventors: Ralph J. Kulesza, Chicago; Howard J. Morrison, Deerfield, both of Ill.

[73] Assignee: Marvin Glass & Associates, Chicago, Ill.

[21] Appl. No.: 343,879

[22] Filed: Jan. 29, 1982

[51] Int. Cl.[3] ..... A63H 17/00

[52] U.S. Cl. ..... 46/206; 46/201

[58] Field of Search ..... 46/202, 201, 206; 63/15, 3, 46

[56] References Cited

U.S. PATENT DOCUMENTS

| | | | |
|---|---|---|---|
| 1,591,521 | 7/1926 | Esser | 46/201 X |
| 3,081,997 | 3/1963 | Glass et al. | 63/15 X |
| 3,959,920 | 6/1976 | Ieda | 46/201 |
| 4,005,543 | 2/1977 | McKay | 46/202 X |

FOREIGN PATENT DOCUMENTS

| | | | |
|---|---|---|---|
| 1043010 | 9/1966 | United Kingdom | 46/201 |

*Primary Examiner*—Mickey Yu

[57] ABSTRACT

A toy vehicle device having the general configuration of a ring wearable on a human finger includes a platform upon which a toy vehicle is mounted for propulsion. The toy vehicle is propelled from the platform by a spring compressed between the vehicle and the platform upon loading of the vehicle onto the platform. The vehicle is releasably held on the platform by a manually actuable catch. A portion of the housing, mounted for pivotal movement under the influence of a normally compressed biasing member, is retained in a first position by a second catch, a portion of which extends outwardly of the vehicle housing to impact any obstacle in the vehicle's path of movement. Upon impact the second catch is released and the vehicle housing portion pivots under the influence of the biasing member.

11 Claims, 9 Drawing Figures

TOY VEHICLE DEVICE

BACKGROUND OF THE INVENTION

1. Field of the Invention

This invention relates generally to toy vehicles and particularly to spring actuated vehicles, action simulating vehicles, and vehicles supportable on the human body.

2. Field of the Invention

The desirability of securing a play toy to the human body for convenient transport and play enhancement has been recognized in the past. The toys marketed under the trademark WRIST RACERS, by The Knickerbocker Toy Company, Inc. are toy vehicles supportable on a platform secured to the wrist by a wristwatch type strap. The vehicles are propelled from the platform onto a surface along an outwardly extending ramp.

In addition a variety of toy vehicles including spring actuated toy vehicles are known in the art. Vehicles capable of simulating exciting vehicle action are also known. For example, U.S. Pat. No. 3,959,920 discloses a toy car with impact responsive means that propels parts of the car away from the chassis upon impact. However, there is a continuing demand for new and entertaining devices of this type.

SUMMARY OF THE INVENTION

A toy vehicle device comprises a vehicle housing including a pivotal housing portion. Means for propelling the housing are included with means for supporting the housing and said propelling means on the human body. Means are also provided to pivot the pivotal housing portion upwardly in response to impact of the housing with an obstacle.

In another preferred embodiment a toy vehicle device includes a wheeled vehicle housing and means for propelling the housing. Means for releasably securing the housing to a human appendage include a ring member arranged to engage a human appendage and to orient the vehicle housing with its direction of propulsion generally parallel to the length of the appendage.

DETAILED DESCRIPTION OF THE PREFERRED EMBODIMENT

Figure 1:
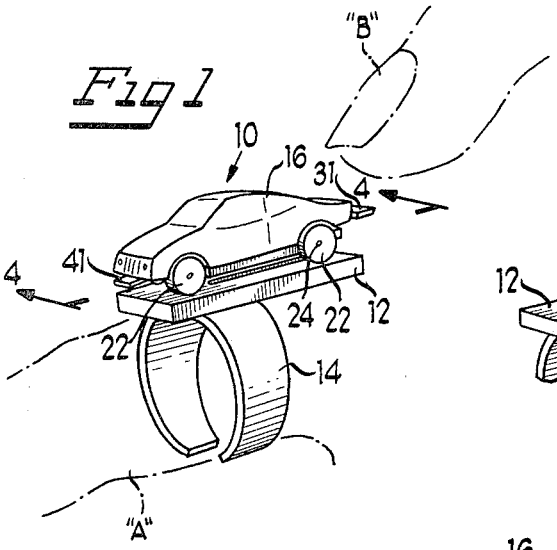
FIG. 1 is a perspective view of one embodiment of the present invention.

Referring to the drawing wherein like reference characters are used for like parts throughout the several views, there is shown in FIG. 1 a toy wheeled vehicle 10 releasably attached to a platform 12, secured by means of a ring 14 to a human appendage such as a finger "A". The vehicle 10 includes an upper housing portion 16 conveniently formed in the shape of a conventional vehicle, such as a car, by means of plastic molding techniques or the like. A vehicle release catch 18 for releasably securing the vehicle 10 to the platform 12 is arranged near the rear of the platform 12 and an upper housing portion release catch 20 is arranged near the forward portion of the platform 12 extending outwardly of the vehicle 10. The vehicle 10 includes a set of four wheels 22 each mounted on a stub axle 24.

Figure 2:
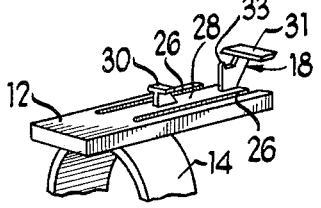
FIG. 2 is a cut-away view of the mounting platform useful in implementing the present invention.
Figure 5:
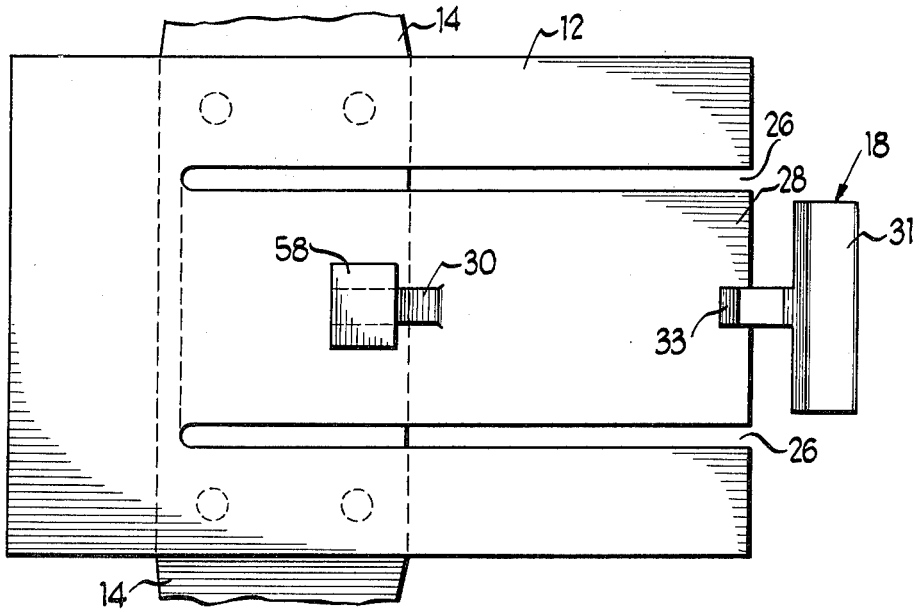
FIG. 5 is an enlarged top plan view of the platform shown in FIG. 2.

Referring now to FIGS. 2 and 5, the platform 12 includes a pair of spaced, generally parallel slits 26 defining an intermediate cantilevered leaf spring 28 which, due to the natural flexibility and resiliency of the material forming the platform 12, returns the catch 18 to its initial position after finger actuation as indicated in FIG. 1. Conveniently the catch 18 is located near the free end of the spring 28 while a T-shaped vehicle support guide 30 is located intermediately along the length of the spring 28. The catch 18 includes a finger engaging surface 31 and a catch tab 33.

Figure 4:
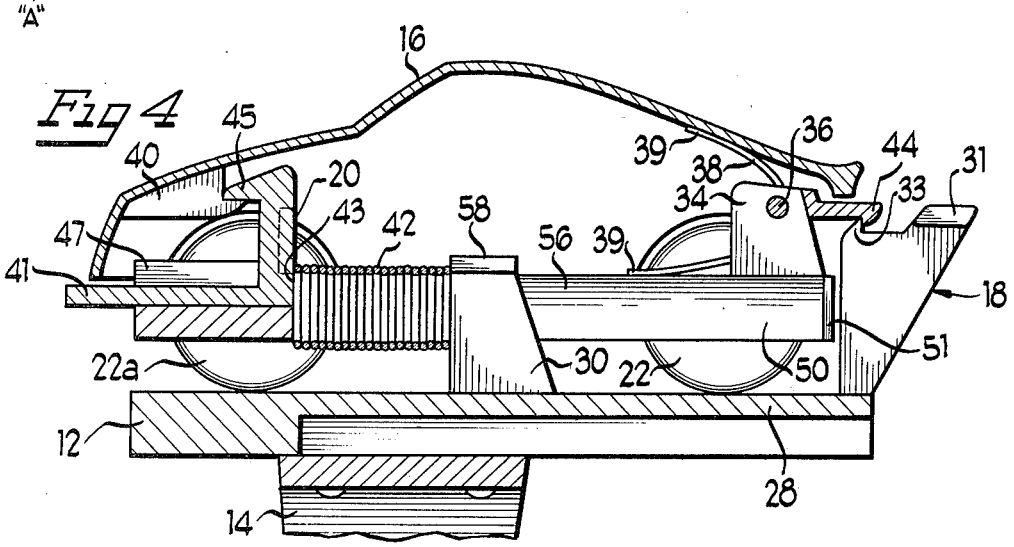
FIG. 4 is an enlarged, partial cross-sectional view taken generally along the lines 4—4 in FIG. 1.
Figure 7:
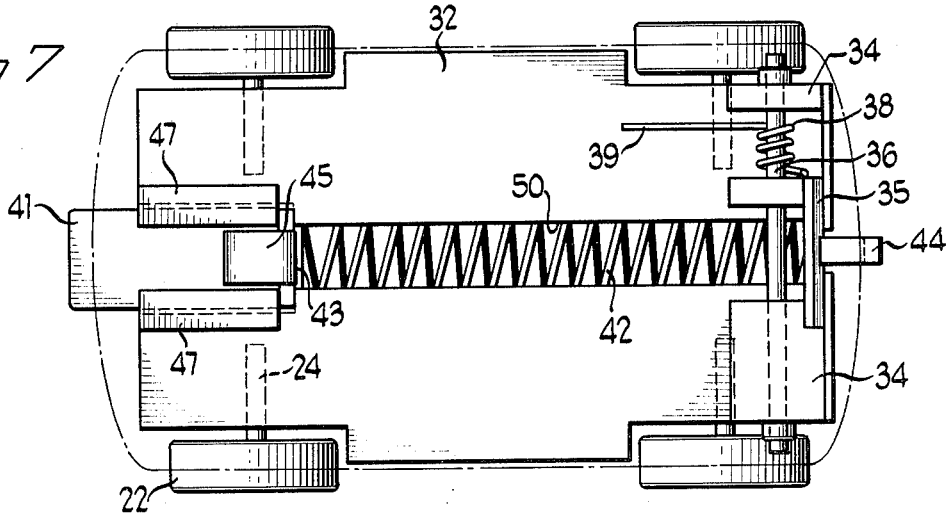
FIG. 7 is a cross-sectional view taken generally along the line 7—7 in FIG. 6.
Figure 8:
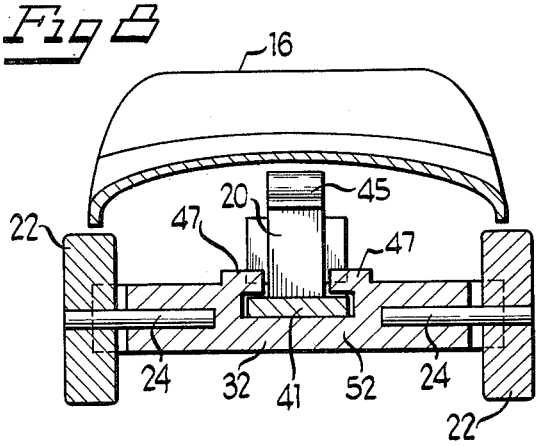
FIG. 8 is a cross-sectional view taken generally along the line 8—8 in FIG. 6.
Figure 9:
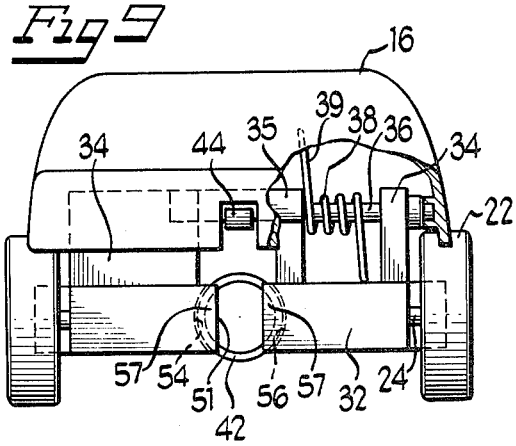
FIG. 9 is a partially cut-away view taken generally along the line 9—9 in FIG. 6.

The upper housing portion 16 of the vehicle 10 is pivotally secured to the vehicle main frame 32 by a main-frame bracket 34 encircling an axle 36 and attached to the main frame 32 and by a bracket 35 encircling the axle 36 and attached to the portion 16, as best shown in FIGS. 7 and 9. A coil spring 38 also encircles the axle 36 with its free ends 39 biased between the inside surface of the portion 16 and the upper surface of the main frame 32 to normally exert a pivotal biasing force upon the housing portion 16. However, the housing portion 16 is secured to the main frame 32 by the catch 20 hooked on a mating catch 40 on the inside surface of the upper housing portion 16 in the front region of the vehicle 10, as shown in FIG. 4. An outwardly extending portion 41 of the catch 20 extends forwardly of the vehicle while the rearmost surface 43 of the catch 20 retains a compressed coil spring 42 between itself and the guide 30. A catch tab 45 on the catch 20 exerts a downward retaining force on the mating catch 40. As shown in FIG. 8, the catch 20 is slidably retained for movement along the length of the vehicle by a pair of opposed guides 47 and the main frame 32.

An additional catch 44, shown in FIG. 4, secured to the main frame 32, engages the vehicle release catch 18 when the vehicle is retained on the platform 12. Upon downward actuation of the finger engaging portion 31 of vehicle release catch 18 the catch 44 flexes around the rearwardly flexing catch tab 33 of the catch 18, releasing the vehicle.

As shown in FIG. 4, the T-shaped guide 30 engages the coil spring 42 when the vehicle is slid along the surface of the platform 12 towards the vehicle release catch 18. More particularly, the guide 30 is arranged to slide along the slot 50, extending along a portion of the length of the main-frame 32 from the opening 51 at the rear of the vehicle approximately to the position of the front wheels 22*a*. Despite the slot 50 the main frame 32 is held together by its uninterrupted front portion 52 shown in FIG. 8 and by the axle 36. The coil spring 42 is trapped by the curved walls 54 and 56 of the main-frame 32 which terminate at one end in the flanges 57 that define the opening 51 and prevent the spring 42 from sliding out the rear of the vehicle 10. The spring 42 may be initially positioned by locating the spring 42 before attaching the flanges 57. When the spring 42 is completely compressed the catch 44 engages the catch 18 and the vehicle is releasably held on the platform 12, as shown in FIG. 4.

Figure 6:
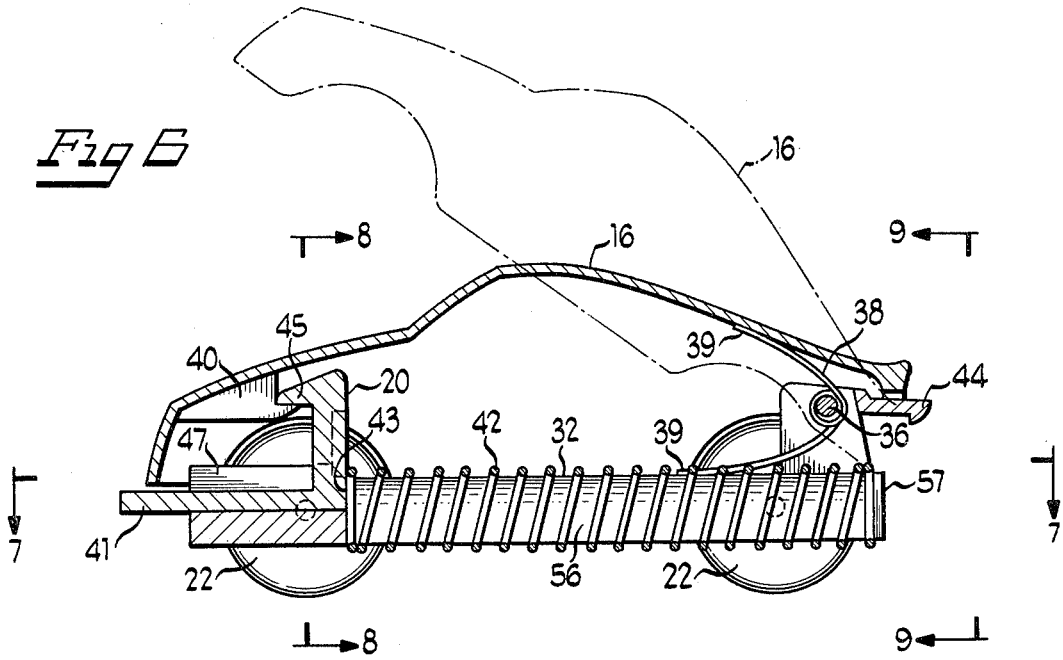
FIG. 6 is an enlarged cross-sectional view of the vehicle shown in FIG. 1 after launching.

The device operates as follows. Upon downward manual actuation of a finger engaging portion 31 of catch 18, as indicated by the finger "B" in FIG. 1, the mating catch 44 is released allowing the vehicle to spring forwardly under the control of the guide 30. As the vehicle moves forwardly under the influence of the coil spring 42 the guide 30 slides along the slot 50 with the cross-portion 58 of the guide 30 straddling the slot 50 and sliding on the upper surface of main-frame 32, ensuring at least initially that the egress of the vehicle is in a generally straight course. When the vehicle platform 12 is positioned on a finger "A" as shown in FIG. 1, the end of the finger provides a ramp allowing the vehicle 10 to ride down the end of the finger onto a playing surface. After release of the vehicle the spring 42 assumes the extended configuration shown in FIGS. 6 and 7 generally extending along the length of the slot 50, retained between the flanges 57 and the catch 20.

Figure 3:
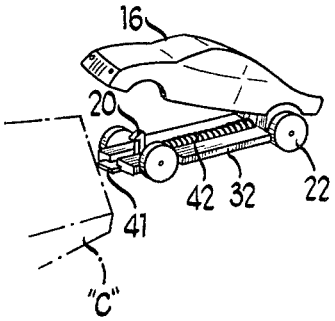
FIG. 3 is a perspective view of the toy vehicle upon impact with an obstacle.

If the vehicle encounters an obstruction "C" along its path, as indicated in FIG. 3, the outwardly extending portion 41 of the upper housing portion release catch 20 slides rearwardly against the bias of the spring 42. As a result, the catch 40 is released and the upper housing portion 16 springs upwardly to the position shown in dotted lines in FIG. 6 under the influence of the spring 38.

While there has been illustrated and described a single embodiment of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent is:

1. A toy vehicle device comprising:

a vehicle housing including a pivotal housing portion;

means for propelling said vehicle housing;

means for supporting said housing and propelling means on the human body, said supporting means including a finger ring; and means for propelling said pivotal housing portion away from the remainder of said housing in response to impact of said housing with an obstacle.

2. The toy vehicle device of claim 1 wherein said vehicle housing is supported on wheels and positionable on said supporting means in an orientation with its direction of propulsion generally coinciding with the length of the finger so that said vehicle can move down the user's finger upon actuation.

3. The toy vehicle device of claim 1 wherein said propelling means includes a coil spring.

4. The toy vehicle device of claim 3 wherein said pivoting means includes a catch normally biased by said spring to a first position retaining said pivotal portion to said housing.

5. The toy vehicle device of claim 1 wherein said pivoting means includes a catch actuator extending outwardly of the front of the vehicle and a catch arranged to normally secure said pivotal portion in a first position but in response to actuation of said catch actuator, arranged to release said pivotal housing portion for rotation under the influence of said pivoting means.

6. The toy vehicle device of claim 1 including biased catch means for releasing said vehicle from said supporting means, said biased catch means being biased by a leaf spring integral with said supporting means.

7. A toy vehicle device comprising:

a wheeled vehicle housing;

means for propelling said housing; and means for releasably securing said housing to a human appendage, said means including a ring member arranged to be worn on a digit of a human hand and to orient said vehicle housing with its direction of propulsion generally parallel to the length of said digit.

8. The toy vehicle device of claim 7 wherein said ring member is a ring wearable on a human finger.

9. The toy vehicle device of claim 7 wherein said propulsion means includes a spring biased between said securing means and said housing.

10. The toy vehicle device of claim 7 wherein said securing means includes a manually actuable catch normally biased to engage said housing.

11. The toy vehicle device of claim 8 including a pivotal housing portion and means for automatically pivoting said housing portion in response to an impact.

* * * * *